US005511668A

United States Patent [19]

Keuschnigg

[11] Patent Number: 5,511,668

[45] Date of Patent: Apr. 30, 1996

[54] PNEUMATIC SIFTER

[76] Inventor: Josef Keuschnigg, Lormanberg 67, 8324 Kirohberg a/d Raab, Austria

[21] Appl. No.: 291,429

[22] Filed: Aug. 16, 1994

[30] Foreign Application Priority Data

Aug. 19, 1993 [DE] Germany ..... 43 27 927.9

[51] Int. Cl.[6] ..... B07B 4/00; B04B 5/12

[52] U.S. Cl. ..... 209/135; 209/148; 209/710; 209/714

[58] Field of Search ..... 209/133, 135, 209/142, 143, 145, 146, 148, 154, 715, 717, 718, 719, 710, 713, 714; 222/410

[56] References Cited

U.S. PATENT DOCUMENTS

| | | | |
|---|---|---|---|
| 4,689,141 | 8/1987 | Folsberg | 209/148 X |
| 4,693,811 | 9/1987 | Lohnherr | 209/154 X |
| 4,818,376 | 4/1989 | Tanaka et al. | 209/148 X |
| 4,869,786 | 9/1989 | Hanke | 209/148 X |
| 5,120,431 | 6/1992 | Cordonnier | 209/135 |
| 5,232,096 | 8/1993 | Weit | 209/148 X |

FOREIGN PATENT DOCUMENTS

| | | | |
|---|---|---|---|
| 397051 | 1/1994 | Austria . | |
| 551764 | 6/1932 | Germany . | |
| 3538832 | 5/1987 | Germany | 209/148 |
| 1468609 | 3/1989 | U.S.S.R. | 209/148 |

*Primary Examiner*—William E. Terrell
*Assistant Examiner*—Tuan Nguyen
*Attorney, Agent, or Firm*—Henry M. Feiereisen

[57] ABSTRACT

A pneumatic sifter includes a feeder for supplying sift material, optionally with sifting air, to a rotationally symmetrical sifting chamber which surrounds a centrally disposed air outlet chamber, and a coarse particle discharge. In order to keep the flow resistance low as air enters into the air outlet chamber, guide vanes are provided in the air outlet chamber, which are spaced from each other at uniform angular distances and extend approximately over the axial extension of the sifting chamber.

21 Claims, 3 Drawing Sheets

PNEUMATIC SIFTER

BACKGROUND OF THE INVENTION

The present invention refers to a pneumatic sifter, and in particular to a pneumatic sifter of the type having a feeder for supplying sift material, optionally with sifting air, to a rotationally symmetrical sifting chamber which surrounds a centrally disposed air outlet chamber, and a coarse particle discharge.

A pneumatic sifter is known e.g. from published Austrian Patent Application A 1527/86.

In this known solution, the material to be sifted is supplied from above, via a vertical pipe, onto a distributing plate, which is connected to a rotor having vanes distributed along its periphery, with the air and the fine particles of the material being drawn off via a central, down-running pipe. The pipe is configured similarly to a telescope, with the individual parts of the pipe being held by means of arms distanced apart in the peripheral direction, thereby enabling the air plus fines to enter the down-running pipe at different levels.

In this solution there is the drawback, however, that the air which is swirled by the vanes of the rotating rotor has to be diverted into the vertical pipe, leading to a high flow resistance and thus resulting in a correspondingly high energy requirement. Moreover, in known sifters of this kind, the finest separation boundary which is attainable is shifted into the coarser region, since coarse material is carried along into the air outlet precisely as a result of the turbulences. This effect is also encountered when increasing the diameter of the sifting chamber to reduce flow losses.

The separation result in the cylindrical sifting chamber is essentially dictated by the fact that the radial flow velocities in vicinity of the inlet periphery of the central air outlet are up to ten times higher than at an axially greater distance from the central air outlet, thereby producing indistinct sifting.

Furthermore, German Pat. No. DE-PS 551 764 discloses a pneumatic sifter of the above-stated type, including guide vanes which confine between them pass-through slots and are disposed in the sifting chamber. The sifting-air guidance is thus realized in the sifting chamber by means of the guide vanes acting as flow brakes, thereby producing a throttling effect upon the flow of sifting air, and hence resulting in high flow losses.

The known sifters are therefore generally configured in such a way that the axial extension of the sifting chamber is chosen to be of such a size that the drawbacks encountered during sifting are still tolerable. For this reason, the majority of pneumatic sifters include a flatly cylindrical sifting chamber with an axial extension which is considerably smaller than the diameter thereof.

SUMMARY OF THE INVENTION

It is an object of the present invention to provide a pneumatic sifter obviating the afore-stated drawbacks.

In particular, it is an object of the present invention to provide a pneumatic sifter which enables a discharge of air together with fines at low flow resistance.

These objects and others which will become apparent hereinafter are attained in accordance with the invention by providing a pneumatic sifter which includes a baffle arrangement in form of a plurality of guide vanes arranged about the outer perimeter of and projecting into the air outlet chamber for guiding the material being separated, with the guide vanes being spaced from each other at even angular distances and extending approximately over the axial extension of the sifting chamber.

The arrangement of the guide vanes results in a reduction of swirls and the flow is correspondingly aligned. Thus, the guide vanes, which are provided in the region of the radial outer perimeter of the air outlet chamber and are disposed directly before the air outlet, ensure a largely undisturbed transition of the air in the region of the guide vanes into an axial direction since ample flow space exists in the center of the air outlet chamber. This results in a largely uniform flow, especially in the sifting chamber preceding the baffle arrangement according to the invention, with the flow running in the peripheral direction rapidly assuming an axial direction as a result of the guide vanes. Consequently, the flow resistance generated upon entry of the air with fines into the air outlet chamber is reduced, with the reduction in flow resistance producing an increase in sifter throughput at same energy consumption in comparison with prior art pneumatic sifters. Moreover, the separating capability is improved, whereby the guide vanes can be held fixedly or even adjustably.

According to a further feature of the present invention, the guide vanes are arranged at an angle in radial direction in the sifting chamber, with all guide vanes preferably exhibiting the same angle in radial direction. Thus, air and fines flow into air outlet chamber at decreasing torsional motion, to thereby attain low flow losses.

Preferably, the guide vanes have a curved cross-section to accomplish reduction in flow resistance in the region of the guide vanes and hence a further increase in sifting throughput and a reduction in pressure losses compared with the swirl-generated outflow.

In accordance with another feature of the present invention, the guide vanes held against the inner side of the air outlet. This results in an overall simple structural design.

In a pneumatic sifter according to the invention with a rotor or sifter wheel which is provided with evenly spaced blades abouts its circumference, a particularly far-reaching reduction of the flow resistances upon entry into the air outlet is accomplished when the rotor surrounds the air outlet chamber and hence the guide vanes disposed therein, with the height of the guide vanes corresponding roughly the height of the sifter wheel.

Preferably, further fixed deflecting baffles are provided outside the guide vanes and/or the rotor or sifting chamber in order to attain particularly favorable conditions in connection with a tangential alignment of the flow.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
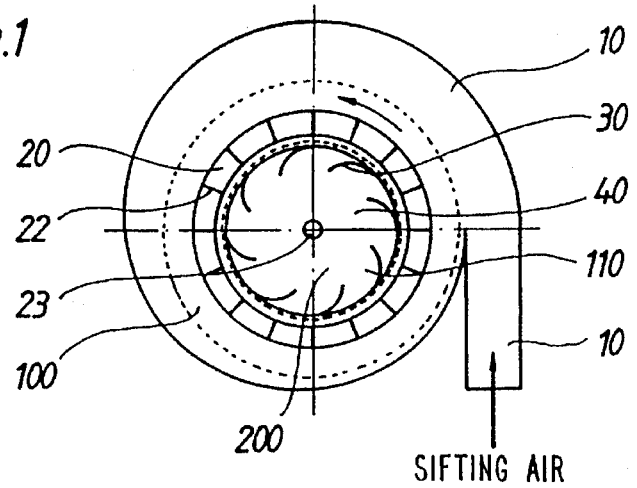
FIG. 1 is a radial section through a pneumatic sifter according to the invention.

Throughout all the Figures, the same or corresponding elements are always indicated by the same reference numerals.

Figure 2A:
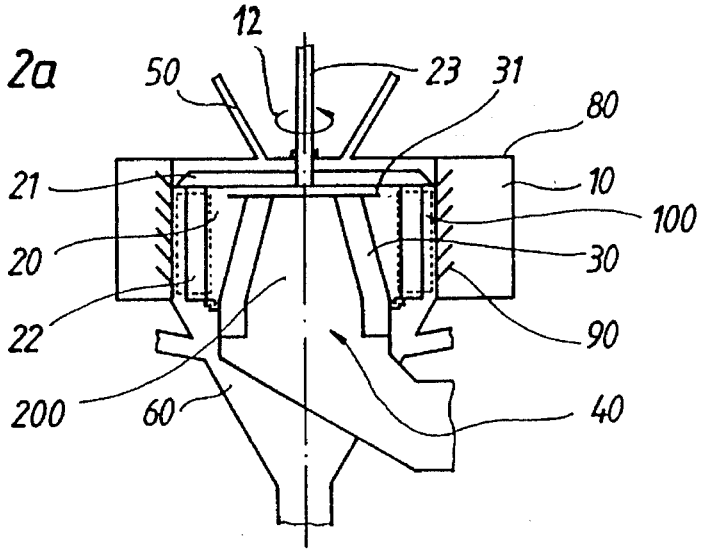
FIG. 2*a* is an axial section through the pneumatic sifter according to FIG. 1, exhibiting a downwardly directed air outlet.
Figure 2B:
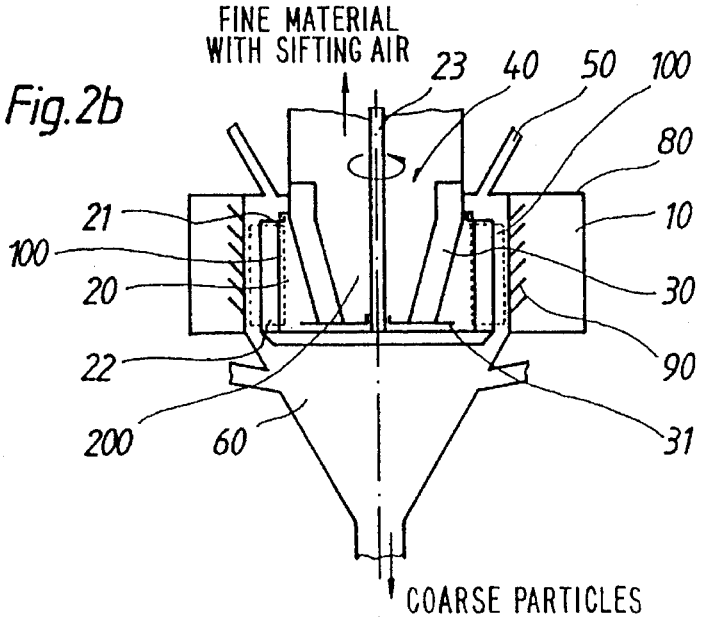
FIG. 2*b* is an axial section through the pneumatic sifter according to FIG. 1, exhibiting an upwardly directed air outlet.

Turning now to the drawing, and in particular to FIGS. 1 and 2, there is show an embodiment of a pneumatic sifter according to the invention with a helical sifting air inlet 10 which surrounds a rotor or sifter wheel 20. The rotor 20 supports a plurality of blades 22 which are spaced about the circumference thereof and extend essentially in axial direction. The rotor 20 is connected to a distributing plate 21 which can also be configured in one piece with the rotor 20.

The rotor 20 and the distributing plate 21 are driven by a shaft 23 and suitable drive in a direction as indicated by arrow 12.

The space which is swept over by the rotating blades 22 corresponds roughly to the rotationally symmetrical sifting chamber 100 which surrounds an air outlet chamber 200 that opens into an air outlet 40 in from of a discharge pipe. The air outlet chamber 200 accommodates along its radial outer perimeter facing the sifting chamber 100 a baffle arrangement in form of a plurality of guide vanes 30 which project into the air outlet chamber 200. As shown e.g. in FIG. 1, the guide vanes 30 are spaced at even angular distances and extend roughly over the axial extension of the sifting chamber 100.

The guide vanes 30 have a curved cross-section and form an angle in radial direction within the sifting chamber 100. Preferably, the guide vanes 30 are arranged at a same angle. The vanes 30 are secured on the inner side of the air outlet 40 and extend essentially in the axial direction of the sifting chamber 100 or air outlet chamber 200. The guide vanes 30 in the central:air outlet chamber 200 are configured in some cases such that the free entry-gap faces 110 correspond at a sifting chamber level equal to the outlet diameter roughly to the area of the central air outlet 40.

In order to prevent the coarse material from being flung out of the sifting chamber 100, ring-shaped conical surfaces 90 may be provided.

Situated beneath the rotor 20 is an essentially funnel-shaped discharge 60 for discharge of coarse particles.

The distributing plate 21 and the rotor 20 as well as also the air inlet 10 are surrounded by a casing 80 which supports on its top side feed hoppers 50 for feeding material to be sifted. The material trickles onto the distributing plate 21 from where the material is hurled in form of a rotating veil of material against the radially inwardly flowing sifting air or outer baffles arrangement 70 and drops downwards. The veil of material is thereby forced by the air which flows via the air inlet tangentially into the region of the rotor 20, against the rotor 20 whereupon the coarser particles, due to the higher centrifugal force, drop downwards in the radially outer region of the rotor 20 into the coarse particle discharge 60.

The air, which is withdrawn via the air outlet 40, flows together with the fines of the material being sifted between the blades 22 of the rotating rotor 20 into the region of the guide vanes 30, between which the flow direction of the radially inflowing air changes to an axial flow direction, with turbulences which would lead to an increase in flow resistance being largely suppressed by the guide vanes 30.

Figure 3:
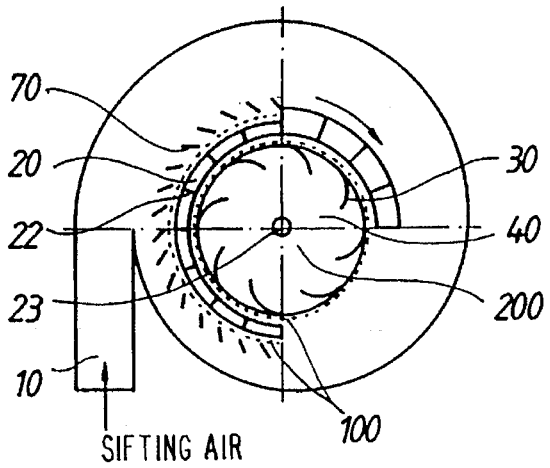
FIG. 3 is a radial section of a composite of further embodiments of a pneumatic sifter according to the invention.
Figure 4:
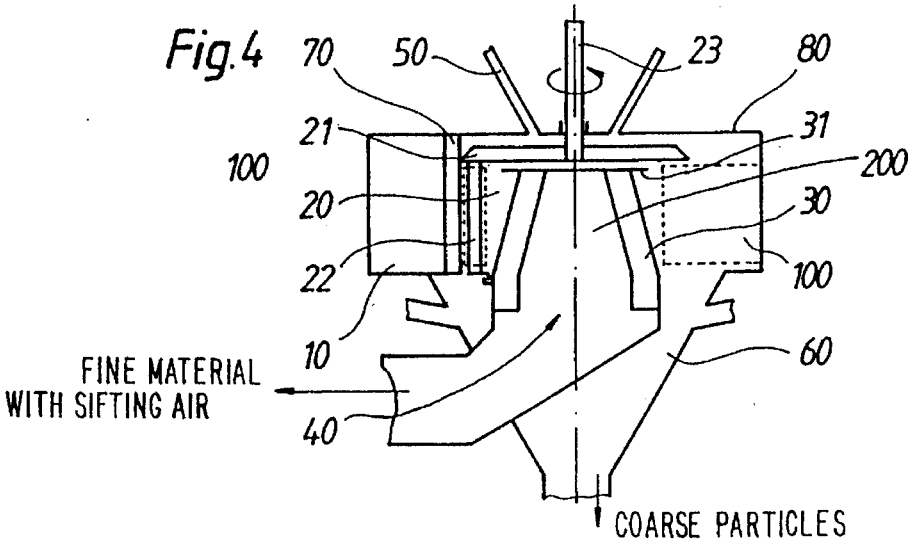
FIG. 4 is an axial section of a composite through further illustrative embodiments of a pneumatic sifter according to the invention.

The left-hand half of FIGS. 3 and 4 illustrates an embodiment of a pneumatic sifter which includes radially outside the rotor 20 further deflecting baffles 70 for correspondingly aligning the air flowing to the rotor and thus to contribute to prevent the sifting chamber 100 from being subjected to different flows.

The upper right-hand half of FIG. 3 illustrates a pneumatic sifter according to the invention with rotor, and the lower right-hand half of FIG. 3 is a same pneumatic sifter without a rotor. Also in these embodiments, fixed deflecting baffles 70 which restrict the air inlet 10 and extend essentially over the entire height of the casing 80 may be provided, with the baffles 70 aligning the air flow which flows to the air outlet 40 and also carries fines of the material being sifted to the guide vanes 30.

From FIG. 4 it can be seen that the air outlet chamber 200 can also be introduced into the casing 80 from below. The air outlet chamber 200 traverses in this case the funnel-shaped coarse particle discharge 60. In the left-hand half of FIG. 4, there is shown an embodiment of a pneumatic sifter with a rotor 20 and with an outer baffle arrangement 70, while the right-hand half of FIG. 4 depicts an embodiment of a pneumatic sifter without a rotor 20 and without an outer baffle arrangement 70.

Figure 5:
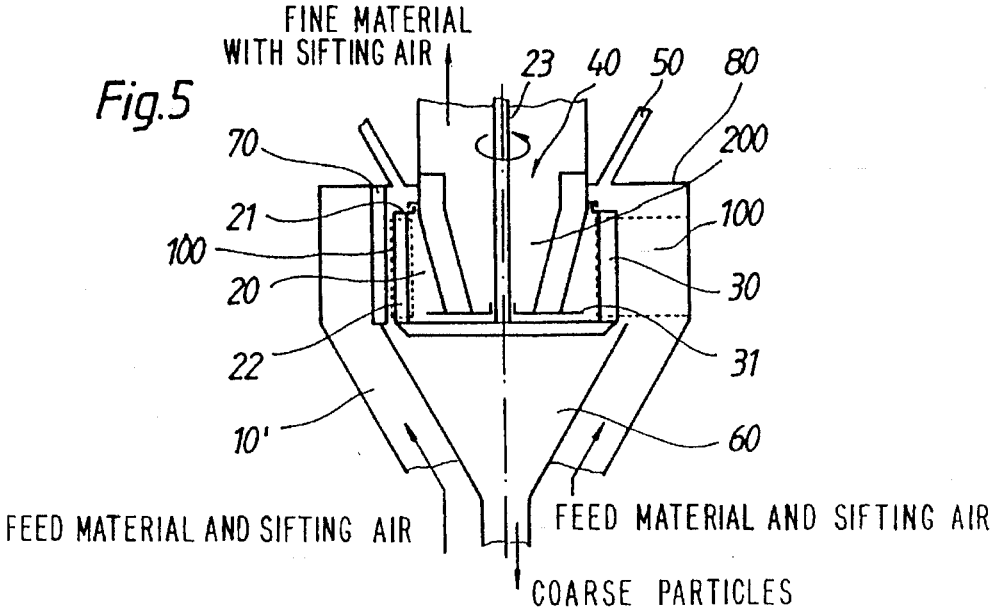
FIGS. 5 and 6 are axial sections through further illustrative embodiments of pneumatic sifters according to the invention.

FIG. 5 shows an further embodiment of a pneumatic sifter in which a helically-shaped air inlet is omitted and an annular air inlet 10' is provided which surrounds the coarse particle discharge 60. The right-hand half of FIG. 5 depicts an embodiment without outer deflecting baffles 70. This embodiment can be further simplified for easy applications by omitting the rotor 20. If the material feed is already realized with the sifting air, as is the case e.g. in milling plants, the distributing plate 21 may also be omitted. This constitutes the simplest embodiment of the pneumatic sifter according to the invention.

Reference numeral 31 designates a cover plate 31 for joining together the guide vanes 30 at their ends distant to the air outlet 40.

Figure 6:
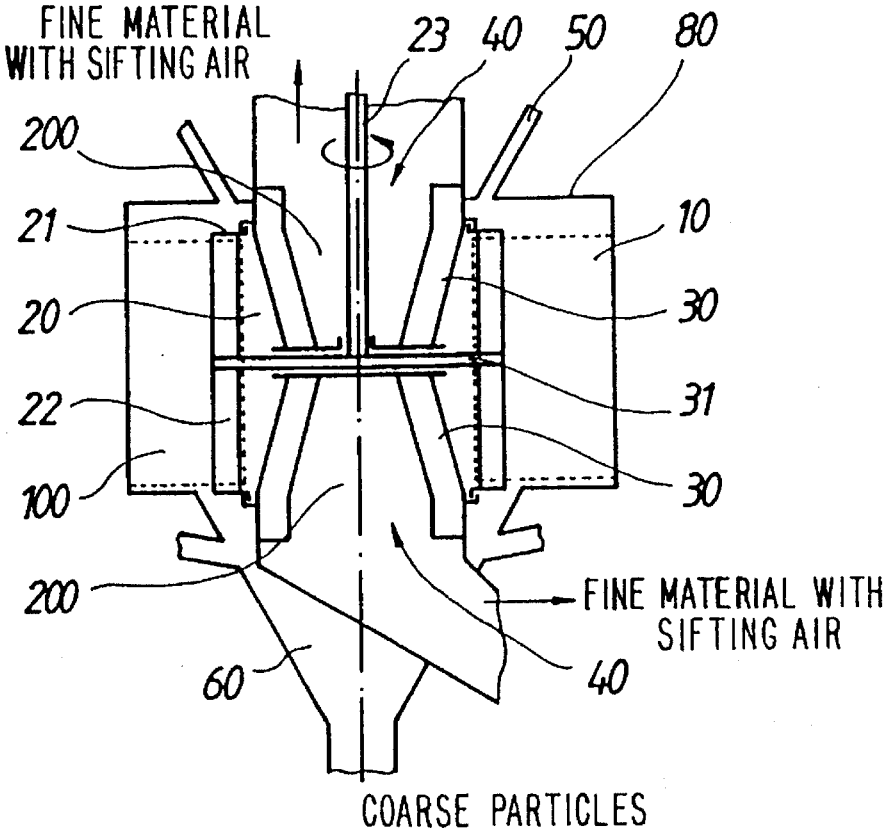

FIG. 6 shows an embodiment of a pneumatic sifter with two air outlet chambers 40, which evacuate the air and fines of sift material in upward and downward directions, with both air outlet chambers accommodating guide vanes 30. The supply of material is in this case realized from above via the feed hoppers 50.

Figure 7:
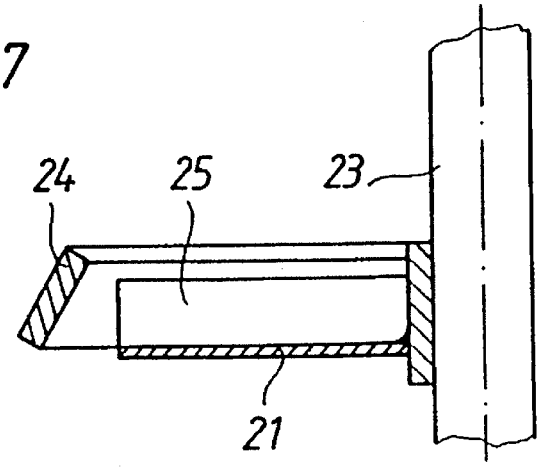
FIG. 7 is a detailed, partially sectional, illustration of a distributing plate.

FIG. 7 shows the distributing plate 21 with ribs 25, between which the sift material is hurled outwards. In a further development of the invention, the distributing plate 21 is provided on the periphery with a ring 24 which projects slantingly downwards and effects a reduction of the radial velocity upon exit from the distributing plate 21 and thus a rotating, vertical veil of material.

While the invention has been illustrated and described as embodied in a pneumatic sifter, it is not intended to be limited to the details shown since various modifications and structural changes may be made without departing in any way from the spirit of the present invention.

What is claimed as new and desired to be protected by Letters Patent is set forth in the appended claims:

1. A pneumatic sifter, comprising:

a casing having a sifting chamber defined by an axial extension and receiving material to be separated, a coarse particle outlet and air outlet means for discharge of air with fines, said air outlet means including an air outlet chamber surrounded by said sifting chamber and a discharge pipe in prolongation of said air outlet chamber and;

baffle means arranged about the outer perimeter of said air outlet chamber and projecting into said discharge pipe for guiding air with fines in an axial direction, said baffle means including guide vanes spaced from each other at uniform angular distances and extending approximately over the axial extension of said sifting chamber.

2. The pneumatic sifter of claim 1 wherein said guide vanes are arranged in radial direction at an angle in said sifting chamber.

3. The pneumatic sifter of claim 2 wherein said guide vanes are arranged at a same angle in radial direction.

4. The pneumatic sifter of claim 1 wherein said guide vanes have a curved cross section.

5. The pneumatic sifter of claim 1 wherein said guide vanes are held on the inside of said air outlet chamber.

6. The pneumatic sifter of claim 1, further comprising a rotor in said sifting chamber and including a plurality of blades evenly spaced about the circumference thereof, said rotor being defined by a height and surrounding said air outlet chamber and said guide vanes, said guide vanes being defined by a height which is equal or greater than the height of said rotor.

7. The pneumatic sifter of claim 1, further comprising stationary baffle plates outside of said guide vanes.

8. The pneumatic sifter of claim 1, further comprising stationary baffle plates outside of said rotor.

9. The pneumatic sifter of claim 1 wherein said baffle means includes a cover plate for joining together said guide vanes at their ends facing away from said air outlet chamber.

10. The pneumatic sifter of claim 1, further comprising an sifting air inlet configured in form of a spiral path outside said guide vanes.

11. The pneumatic sifter of claim 1, further comprising a distributing plate operatively connected to a drive and arranged above said sifting chamber.

12. The pneumatic sifter of claim 11 wherein said distributing plate is provided about its circumference with a ring extending slantingly downwards.

13. A baffle arrangement for use in a pneumatic sifter of a type including a casing having a sifting chamber, a coarse particle outlet and an air outlet means for discharge of air with fines, said air outlet means including an air outlet chamber surrounded by said sifting chamber and a discharge pipe in prolongation of said air outlet chamber, said baffle arrangement including guide vanes arranged about the outer perimeter of and projecting into said discharge pipe for guiding air with fines in an axial direction, said guide vanes being spaced from each other at uniform angular distances and extending approximately over an axial extension of said sifting chamber.

14. The baffle arrangement of claim 13 wherein said guide vanes are arranged in radial direction at an angle in the sifting chamber.

15. The baffle arrangement of claim 14 wherein said guide vanes are arranged at a same angle in radial direction.

16. The baffle arrangement of claim 13 wherein said guide vanes have a curved cross section.

17. The baffle arrangement of claim 13 wherein said guide vanes are mounted on the inside of the air outlet chamber.

18. The baffle arrangement of claim 13 wherein said guide vanes have a height which is equal or greater than the height of a rotor placed in the sifting chamber and surrounding the air outlet chamber.

19. The baffle arrangement of claim 13, further comprising stationary baffle plates outside of said guide vanes,

20. The baffle arrangement of claim 18, further comprising stationary baffle plates outside of the rotor.

21. The baffle arrangement of claim 13, further comprising a cover plate for joining together said guide vanes at their ends facing away from the air outlet chamber.

* * * * *

UNITED STATES PATENT AND TRADEMARK OFFICE

CERTIFICATE OF CORRECTION

PATENT NO. : 5,511,668

DATED : April 30, 1996

INVENTOR(S) : Josef Keuschnigg

It is certified that error appears in the above-indentified patent and that said Letters Patent is hereby corrected as shown below:

Column 2, line 36, add --are-- after "vanes."
Column 2, line 45, add --to-- after "roughly."
Column 3, line18, change "show" to --shown--.
Column 3, line 31, change "from" to --form--.
Column 3, line 45, change "central:air" to --central air--.

On the title page, item [76], change "Kirohberg" to --Kirchberg--.

Signed and Sealed this

Twenty-sixth Day of November 1996

*Attest:*

*Attesting Officer*

Bruce Lehman

BRUCE LEHMAN

*Commissioner of Patents and Trademarks*